US010625981B2

(12) United States Patent
Rosenthal

(10) Patent No.: US 10,625,981 B2
(45) Date of Patent: Apr. 21, 2020

(54) STAIRLIFT, FOR TRANSPORTING A LOAD ALONG A STAIRCASE

(71) Applicant: Handicare Stairlifts B.V., Heerhugowaard (NL)

(72) Inventor: Dov Rosenthal, Amstelveen (NL)

(73) Assignee: Handicare Stairlifts B.V., Heerhugowaard (NL)

( * ) Notice: Subject to any disclaimer, the term of this patent is extended or adjusted under 35 U.S.C. 154(b) by 206 days.

(21) Appl. No.: 15/519,572

(22) PCT Filed: Oct. 21, 2015

(86) PCT No.: PCT/NL2015/050726

§ 371 (c)(1),
(2) Date: Apr. 17, 2017

(87) PCT Pub. No.: WO2016/064268

PCT Pub. Date: Apr. 28, 2016

(65) Prior Publication Data

US 2017/0247227 A1 Aug. 31, 2017

(30) Foreign Application Priority Data

Oct. 21, 2014 (NL) ..... 2013660

(51) Int. Cl.
*B66B 9/08* (2006.01)
*A61G 7/10* (2006.01)

(52) U.S. Cl.
CPC ..... *B66B 9/0815* (2013.01); *A61G 7/10* (2013.01); *B66B 9/0838* (2013.01); *B66B 9/08* (2013.01); *B66B 9/0846* (2013.01)

(58) Field of Classification Search
CPC ..... B66B 9/0815; B66B 9/0838; A61G 7/10
See application file for complete search history.

(56) References Cited

U.S. PATENT DOCUMENTS 5,908,087 A * 6/1999 Johansson ..... B66B 9/0838 187/201
6,155,382 A * 12/2000 Duijnstee ..... B66B 9/0838 187/200

(Continued)

FOREIGN PATENT DOCUMENTS

CN 1718527 A 1/2006
EP 0881188 A1 12/1998

(Continued)

OTHER PUBLICATIONS

English translation of Chinese Office Action for corresponding Chinese Application No. 201580057284.0, dated Aug. 22, 2018, 7 pages.

*Primary Examiner* — Michael A Riegelman
(74) *Attorney, Agent, or Firm* — Hoffman & Baron, LLP

(57) ABSTRACT

A stairlift with an elongated rail includes a first side running surface and a second side running surface; and a carriage movable along the rail. The carriage having a first roller including a first roller friction surface which is in frictional engagement with the first side running surface for guiding the first roller; and a second roller including a second roller friction surface which is in frictional engagement with the second side running surface for guiding the second roller; and a first bridge. The first roller being rotatable around a first axis at a first end of the first bridge and the second roller is being rotatable around a second axis at a second end of the first bridge.

17 Claims, 5 Drawing Sheets

(56) References Cited

U.S. PATENT DOCUMENTS 6,332,512 B1 * 12/2001 Muranaka ..... B66B 9/0815 104/118
6,666,147 B1 * 12/2003 Minges ..... B61B 7/06 104/128
6,755,136 B2 * 6/2004 Jenkins ..... B66B 9/0815 105/141
7,225,899 B2 * 6/2007 Molnar ..... B66B 9/0807 187/201
2004/0104078 A1 * 6/2004 Szentistvany ..... B66B 9/0815 187/201
2008/0128213 A1 * 6/2008 Harris ..... B66B 9/08 187/201
2008/0271953 A1 * 11/2008 Vroegindeweij ..... B66B 9/0838 187/245
2010/0101894 A1 * 4/2010 Szentistvany ..... B66B 9/0807 187/200
2011/0024237 A1 * 2/2011 Vroegindeweij ..... B66B 9/0838 187/201
2012/0073908 A1 * 3/2012 Rosenthal ..... B66B 9/08 187/201
2012/0261216 A1 * 10/2012 Hrenchir ..... B66B 9/0846 187/201
2014/0083801 A1 * 3/2014 Vroegindeweij ..... B66B 9/0815 187/201
2014/0151157 A1 * 6/2014 Hall ..... B66B 9/0838 187/201
2015/0034423 A1 * 2/2015 Ooms ..... B66B 9/0846 187/201
2017/0158464 A1 * 6/2017 De Kroon ..... B66B 9/0838
2017/0233223 A1 * 8/2017 Hoedjes ..... B66B 9/0838 187/201
2017/0247227 A1 * 8/2017 Rosenthal ..... B66B 9/0815

FOREIGN PATENT DOCUMENTS

EP 1614650 A2 1/2006
FR 2898854 A1 9/2007
NL 2005398 C 3/2012
WO 2014/098575 A1 6/2014

* cited by examiner

STAIRLIFT, FOR TRANSPORTING A LOAD ALONG A STAIRCASE

CROSS-REFERENCE TO RELATED APPLICATIONS

This application is the National Stage of International Application No. PCT/NL2015/050726 filed Oct. 21, 2015, which claims the benefit of Netherlands Application No. NL 2013660, filed Oct. 21, 2014, the contents of which is incorporated by reference herein.

FIELD OF THE INVENTION

The invention relates to the field of stairlifts, for transporting a load along a staircase. The stairlift comprises;

an elongated rail comprising a first side running surface and a second side running surface opposing the first side running surface; and a carriage movable along the rail said carriage comprising:

a first roller comprising a first roller friction surface which is in frictional engagement with the first side running surface for guiding the first roller; and, a second roller comprising a second roller friction surface which is in frictional engagement with the second side running surface for guiding the second roller; and, a first bridge, the first roller being provided rotatable around a first axis at a first end of the first bridge and the second roller is being provided rotatable around a second axis at a second end of the first bridge.

BACKGROUND OF THE INVENTION

The stairlift may be used to convey a person who has difficulties with walking along the staircase. The elongated rail may extend in such a situation along the staircase. The load may be a load carrier, such as a chair or a wheelchair platform for carrying the person. The friction between the roller friction surfaces of the first and second roller and the first and second side running surface of the elongated rail may be used for driving the carriage up and down the rail with a motor or the friction may be used by a brake. An example of such a lift is disclosed in NL2005398.

A necessity of using friction is that there is sufficient preload on the rollers to press the rollers on the elongated rail in all circumstances.

SUMMARY OF THE INVENTION

Its an objective of the invention to provide an improved stairlift and/or a stairlift in which the preload is increased. Accordingly there is provided a stairlift, for transporting a load along a staircase, comprising;

an elongated rail comprising a first side running surface and a second side running surface opposing the first side running surface; and a carriage movable along the rail said carriage comprising:

a first roller comprising a first roller friction surface which is in frictional engagement with the first side running surface for guiding the first roller; and, a second roller comprising a second roller friction surface which is in frictional engagement with the second side running surface for guiding the second roller; and, a first bridge, the first roller being provided rotatable around a first axis at a first end of the first bridge and the second roller being provided rotatable around a second axis at a second end of the first bridge, wherein the first bridge is turnably mounted in the carriage around a third axis substantially parallel to the first and/or second axis and the first bridge is constructed to support the load at a position closer to the first roller than to the second roller.

By providing the first bridge turnably mounted in the carriage around a third axis substantially parallel to the first and/or second axis and the first bridge being constructed to support the load at a position closer to the first roller than to the second roller the load may cause a couple in the bridge around the third axis. The couple presses the rollers against the first and second side running surfaces with a force causing a preload on the rollers improving the friction between the rollers and the first and second side running surfaces. Since the preload is dependent on the load that is carried the friction increases as the load is increasing which is advantageous because an increased friction is necessary if the load is increasing.

Due to wear the roller diameter may decrease. The preload brings the roller always in good contact with the side running surfaces.

According to an embodiment the first bridge is turnably around the third axis over an angle of 0 to 25, more preferably 0 to 10, and most preferably 0.1 to 2 degrees with respect to a longitudinal direction of the elongated rail.

By having the first bridge turnably around the third axis over a relatively small angle the load may cause a couple in the bridge and the couple may cause that the rollers are pressed against the first and second side running surfaces with a greater force improving the friction between the rollers and the first and second side running surfaces.

According to an embodiment the elongated rail is mountable at a lower end and an upper end (e.g. of the staircase) such that the stairlift can move the load up and down the elongated rail from the lower end to the upper end and vice versa, the first roller being constructed closer to the lower end of the elongated rail than the second roller.

By constructing the first bridge such that the first roller is closer to the lower end of the elongated rail, the angle of the first bridge with respect to the elongated rail becomes smaller and the preload on the running side surface generated by the couple become higher.

According to an embodiment the first bridge is constructed in the stairlift carriage making an angle of 10 to 80, more preferably 20 to 65, and most preferably 30 to 50 degrees with a longitudinal direction of the elongated rail.

At these angles there is a nice ability to meet the tolerance between preload and stroke.

According to an embodiment the carriage comprises: a third roller comprising a third roller friction surface which is in frictional engagement with the second side running surface for guiding the third roller; and, a fourth roller comprising a fourth roller friction surface which is in frictional engagement with the first side running surface for guiding the fourth roller, wherein the third roller is provided rotatable around a fourth axis in a first end of a second bridge and the fourth roller is provided rotatable around a fifth axis at second end of the second bridge and the second bridge is turnably around a sixth axis substantially parallel to the fourth and/or fifth axis mounted in the stairlift.

By having a second bridge with its third and fourth rollers the carriage is stabile in the rotational direction around an axis perpendicular to the side running surface of the elongated rail.

According to an embodiment the second bridge is turnably around the sixth axis over an angle of 0 to 25, more preferably 0 to 10, and most preferably 0.1 to 2 degrees with respect to a longitudinal direction of the elongated rail.

By having the second bridge turnably around the sixth axis over a relatively small angle the load may cause a couple in the bridge and the couple may cause that the rollers are pressed against the first and second side running surfaces with a greater force improving the friction between the rollers and the first and second side running surfaces.

According to an embodiment the first and second bridge are connected with a rear plate connecting the first bridge and the second bridge at a rear end of the first and second bridge.

The rear plate may transmit the load to the second bridge as well.

According to an embodiment the rear plate is bendable in a direction perpendicular to the second side running surface of the elongated rail to allow the first and second bridge to be turnably around the third respectively sixth axis over an angle of 0 to 25, more preferably 0 to 10, and most preferably 0.1 to 2 degrees with respect to a longitudinal direction of the elongated rail.

This may be necessary to transmit the load to the second bridge and at the same time allow for rotation around the third and sixth axis.

According to a further embodiment the first and second bridge are turnably in an opposite direction.

This allows for ease of construction and symmetry such that the load can be suspended from the carriage at two sides.

According to an embodiment the rear plate is provided with a pretention to turn the first an second bridge in opposite direction.

The first and second bridge thereby provide a preload to the rollers.

According to an embodiment a front end of one of the first or second bridge is rigidly connected with a front plate which is connected with a front end of the other one of the first or second bridge by a connection allowing movement of the other one of the first and second bridge with respect to the front plate in a direction parallel to the longitudinal direction of the elongated rail.

The front plate allows the first and second bridge to be turnably with respect to each other while at the same time allowing for stability in the longitudinal direction of the elongated rail.

According to an embodiment the third roller is closer to the lower end of the elongated rail than the fourth roller.

By constructing the bridge such that the first end of the second bridge is closer to the lower end of the elongated rail the angle of the second bridge with respect to the elongated rail becomes smaller and the forces perpendicular to the running side generated by the couple become higher.

According to an embodiment the second bridge is constructed in the stairlift making an angle of 10 to 80, more preferably 20 to 65, and most preferably 30 to 50 degrees with respect to the elongated rail.

At these angles there is a nice ability to meet the tolerance between preload and stroke.

According to an embodiment the first and second bridge are constructed in the stairlift tunably in the same direction.

This allows a compact and more simplified solution.

According to an embodiment the first roller friction surface is provided with a first roller member which peripherally extends in a plane perpendicular to a rotational axis of the first roller and the first side running surface is provided with a longitudinal first side running surface member which fits complementary with the first roller member for supporting the first roller on the first side running surface; and, the second roller friction surface is provided with a second roller member which peripherally extends in a plane perpendicular to a rotational axis of the second roller and the second side running surface is provided with a longitudinal second side running surface member which fits complementary with the second roller member for supporting the second roller on the second side running surface.

The friction provided by the first and second roller friction surface on the first and second side running surface may be increased and tolerances can be absorbed by the stairlift.

According to an embodiment the third roller friction surface is provided with a third roller member which peripherally extends in a plane perpendicular to a rotational axis of the third roller and fits complementary with the longitudinal second side running surface member for supporting the third roller on the second side running surface; and, the fourth roller friction surface is provided with a fourth roller member which peripherally extends in a plane perpendicular to a rotational axis of the fourth roller and fits complementary the longitudinal second side running surface member for supporting the fourth roller on the first side running surface.

The friction provided by the third and fourth roller friction surface on the first and second side running surface may be increased and tolerances in the width of the elongated rail can be better accommodated.

According to an embodiment each roller is provided with a motor for driving the roller. In this way the friction of each roller will help moving the load.

According to an embodiment the motor is supported by the first and/or second bridge. Providing for a compact design of the stairlift.

According to a further embodiment there is provided a method of operating a stairlift for transporting a load along a staircase over an elongated rail comprising a first side running surface and a second side running surface opposing the first side running surface;

rotating a first roller comprising a first roller friction surface which is in frictional engagement with the first side running surface around a first axis in a front end of a first bridge;

rotating a second roller comprising a second roller friction surface which is in frictional engagement with the second side running surface around a second axis in a rear end of the first bridge;

suspending a load from the first bridge at a position closer to the first roller than to the second roller; and, allowing the first bridge to turn around a third axis substantially parallel to the first and/or second axis.

According to a further embodiment allowing the first bridge to turn around a third axis comprises allowing the first bridge to turn around the third axis over an angle of 0 to 25, more preferably 0 to 10, and most preferably 0.1 to 2 degrees with respect to a longitudinal direction of the elongated rail.

BRIEF DESCRIPTION OF THE DRAWINGS

Embodiments of the invention will be described, by way of example only, with reference to the accompanying schematic drawings in which corresponding reference symbols indicate corresponding parts, and in which.

DETAILED DESCRIPTION OF THE INVENTION

Figure 1:
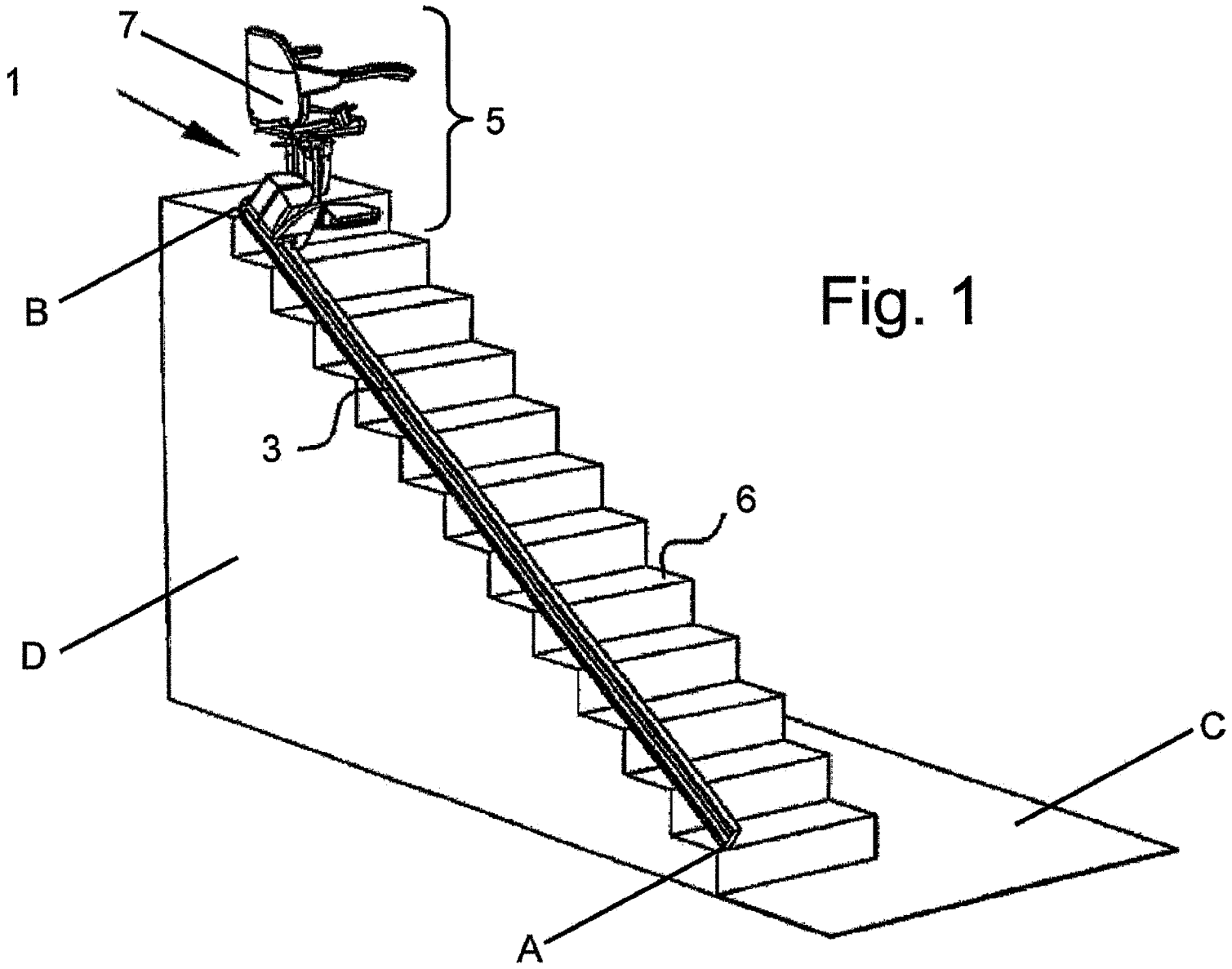
FIG. 1 shows a perspective view of a stairlift and a staircase.

FIG. 1 shows an example of a stairlift 1 which comprises an elongated rail 3 and a carriage 5. The elongated rail 1 is arranged along a staircase 6. The staircase may be used by a person to transport himself from a lower floor to an upper floor and vice versa. In FIG. 1 it is shown that the elongated rail 1 is arranged from lower end A to upper end B. When the person is handicapped or for other reasons unable to use the staircase 6, the person may use the stairlift 1 to be transported from a lower end A to an upper end B and vice versa. In this embodiment the stairlift 1 further comprises a load carrier 7 in the form of a seat. The load carrier 7 may be used by the person to sit on. Particularly, when the person is seated in the load carrier 7 the person may be transported between lower end A and upper end B and vice-versa. Alternatively, the load carrier 7 is a flat platform for carrying a wheel chair or goods. In FIG. 1 the elongated rail 3 is shown as a straight guide.

Figure 2:
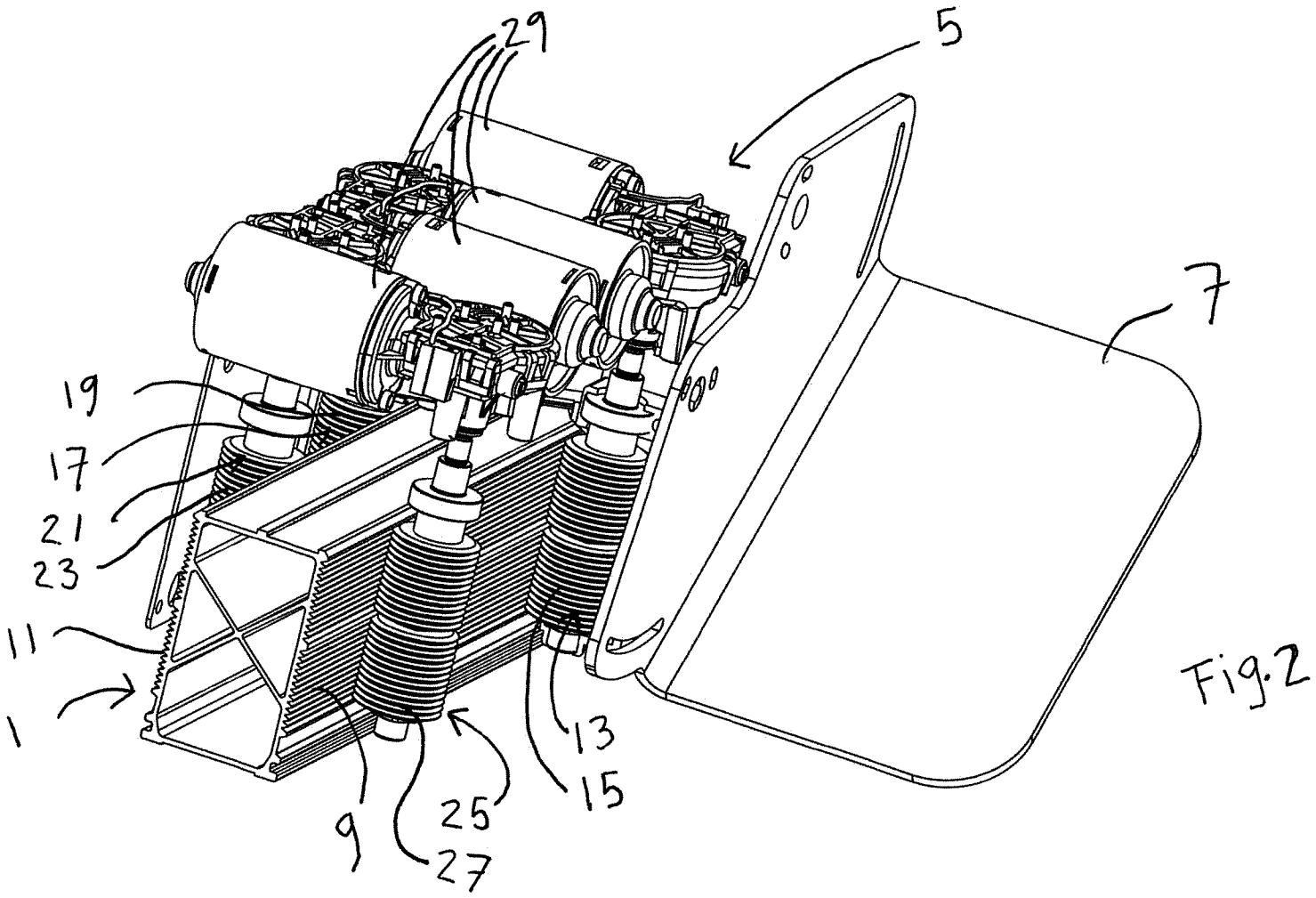
FIG. 2 shows a perspective view on a carriage of a stairlift according to an embodiment with some of the plates removed.

FIG. 2 shows a perspective view on a part of the stairlift showing a part of the elongated rail 1 and the carriage 5. The elongated rail 1 comprises a first side running surface 9 and a second side running surface 11 opposing the first side running surface. The carriage 5 is movable along the rail 1 by a first roller 13 having a first roller friction surface 15 which is in frictional engagement with the first side running surface 9 for guiding the first roller 13 and by a second roller 17 having a second roller friction surface 19 which is in frictional engagement with the second side running surface 11 for guiding the second roller 17.

The first roller friction surface 15 may be provided with a first roller member which peripherally extends in a plane perpendicular to a rotational axis of the first roller and the first side running surface 9 may be provided with a longitudinal first side running surface member which fits complementary with the first roller member for supporting the first roller 13 on the first side running surface 9. The second roller friction surface 17 may be provided with a second roller member which peripherally extends in a plane perpendicular to a rotational axis of the second roller 17 and the second side running surface 11 is provided with a longitudinal second side running surface member which fits complementary with the second roller member for supporting the second roller on the second side running surface. The friction provided by the first and second roller friction surface on the first and second side running surface may be increased by this.

For extra stability, for example, in the rotational direction around an axis perpendicular to the side running surface 9 of the elongated rail 1 the carriage 5 may optionally be provided with a third roller 21 having a third roller friction surface 23 which is in frictional engagement with the second side running surface 11 for guiding the third roller 21 and a fourth roller 25 comprising a fourth roller friction surface 27 which is in frictional engagement with the first side running surface 9 for guiding the fourth roller 25.

The third roller friction surface 23 may be provided with a third roller member which peripherally extends in a plane perpendicular to a rotational axis of the third roller and fits complementary with the longitudinal second side running surface member for supporting the third roller on the second side running surface 11. The fourth roller friction surface 27 is provided with a fourth roller member which peripherally extends in a plane perpendicular to a rotational axis of the fourth roller and fits complementary the longitudinal second side running surface member for supporting the fourth roller on the first side running surface 9. The friction provided by the third and fourth roller friction surface on the first and second side running surface may be increased by this. The second roller 17 or each roller 15, 17, 21, 25 may be provided with a motor 29 for driving the roller and a load carrier 7 for carrying a load.

Figure 3:
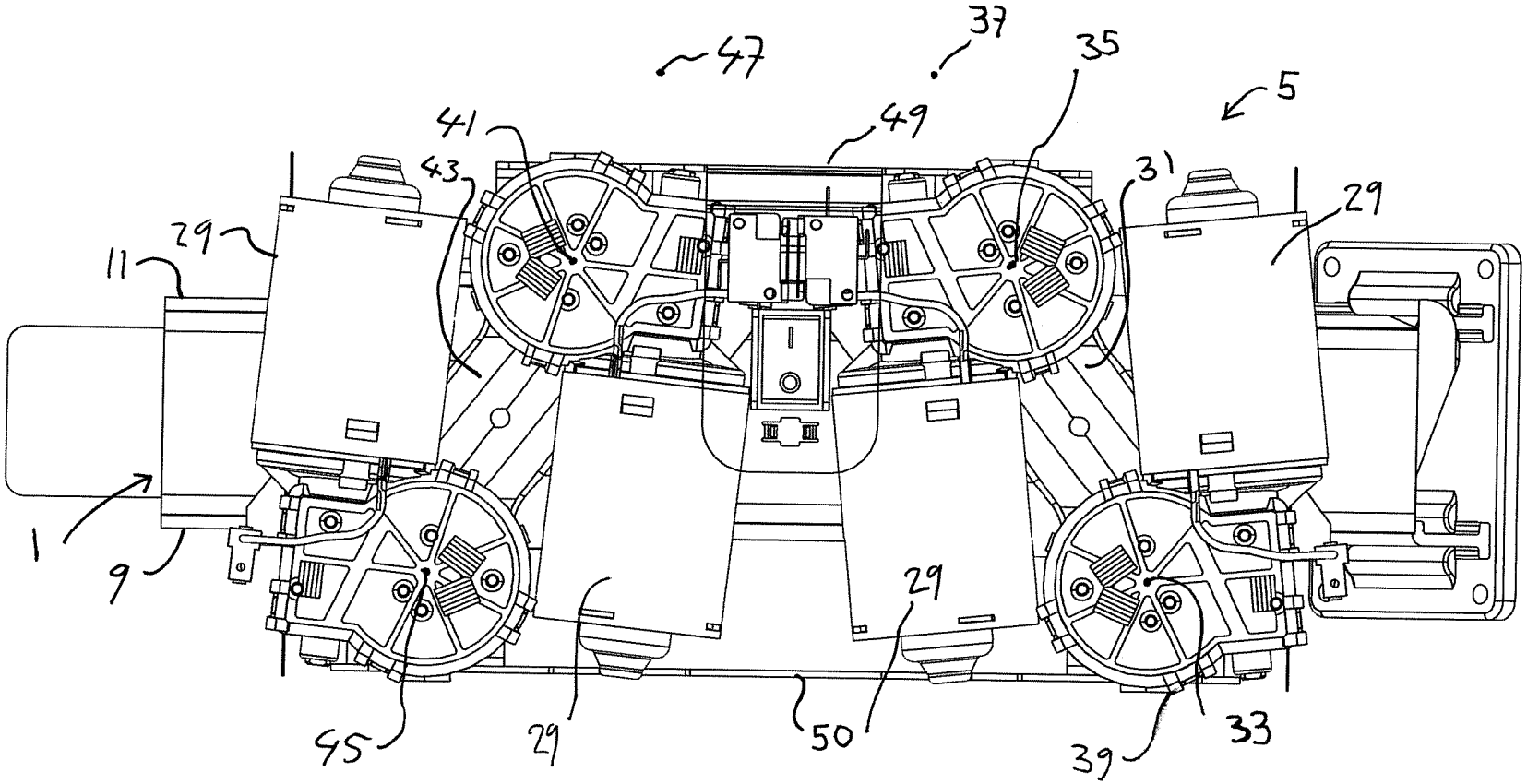
FIG. 3 shows a perspective top view on the carriage of FIG. 2 with the plates in place.

FIG. 3 shows a perspective top view on the carrier 5 showing a first bridge 31, the first roller being provided rotatable around a first axis 33 at a first end of the first bridge 31 and the second roller is being provided rotatable around a second axis 35 at a second end of the first bridge. The first bridge 31 is turnably mounted in the carriage around a third axis 37 substantially parallel to the first and/or second axis 33, 35 and the first bridge is constructed to support the load at a position 39 closer to the first roller than to the second roller. By providing the first bridge turnably mounted in the carriage around a third axis 37 substantially parallel to the first and/or second axis 33, 35 and the first bridge 31 being constructed to support the load at a position closer to the first roller than to the second roller the load may cause a couple in the bridge 31. The couple may cause that the rollers are pressed against the first and second side running surfaces 9, 11 with a greater force improving the friction between the rollers and the first and second side running surfaces. Since the couple is dependent on the load that is carried the friction increases as the load is increasing which is advantageous because an increased friction is necessary if the load is increasing.

Optionally, the third roller may be provided rotatable around a fourth axis 41 in a first end of a second bridge 43 and the fourth roller is provided rotatable around a fifth axis 45 at a second end of the second bridge and the second bridge is turnably around a sixth axis 47 substantially parallel to the fourth and/or fifth axis mounted in the stairlift. By having the second bridge 43 with its third and fourth rollers the carriage 5 is provided with stability in the rotational direction around an axis perpendicular to the side running surface 9, 11 of the elongated rail.

The first bridge 31 may be turnably around the third axis 37 over an angle of 0 to 25, more preferably 0 to 10, and most preferably 0.1 to 2 degrees with respect to a longitudinal direction of the elongated rail 1. By having the first bridge 31 turnably around the third axis 37 over a relatively small angle the load may cause a couple in the bridge and the couple may cause that the rollers are pressed against the first and second side running surfaces 9, 11 with a greater force improving the load on the rollers and therefore the friction between the rollers and the first and second side running surfaces.

The motors 29 may be suspended from the first and second bridge 43, 31.

The elongated rail 1 may be mountable at a lower end A and an upper end B (see FIG. 1) such that the stairlift can move the load up and down the elongated rail from the lower end to the upper end and vice versa, the first end of the first bridge 31 being constructed closer to the lower end of the elongated rail 1 than the second end of the first bridge 31. By constructing the first bridge 31 such that the first end of the first bridge is closer to the lower end of the elongated rail the angle of the first bridge with respect to the elongated rail 1 becomes smaller and the forces perpendicular to the running side surface 9, 11 become higher.

According to an embodiment the first bridge 31 is constructed in the stairlift making an angle of 10 to 80, more preferably 20 to 65, and most preferably 30 to 50 degrees with a longitudinal direction of the elongated rail 1.

The angle of the first bridge with respect to the elongated rail determines the ratio between the forces perpendicular to the side running surfaces 9, 11 and the stroke. This ratio becomes better between 10 to 80, more preferably 20 to 65, and most preferably 30 to 50 degrees. At these angles there is a nice ability to meet the tolerances caused for example by wear of the rollers. Due to the load the rollers are brought in to good contact with the running surfaces of the rail.

The second bridge 43 may be turnably around the sixth axis over an angle of 0 to 25, more preferably 0 to 10, and most preferably 0.1 to 2 degrees with respect to a longitudinal direction of the elongated rail 1. By having the second bridge 43 turnably around the sixth axis 47 over a relatively small angle the load may cause that the rollers are pressed against the first and second side running surfaces 9, 11 with a greater force improving the friction between the rollers and the first and second side running surfaces 9, 11.

The first and second bridges 31, 43 are connected with a rear plate 49 connecting the first bridge 31 and the second bridge 43 at the second end (e.g. a rear end) of the first and second bridge. The rear plate may transmit the load to the second bridge as well.

The rear plate 49 is bendable in a direction perpendicular to the second side running surface 11 of the elongated rail 1 to allow the first and second bridge 31, 43 to be turnably around the third respectively sixth axis 37, 47 over an angle of 0 to 25, more preferably 0 to 10, and most preferably 0.1 to 2 degrees with respect to a longitudinal direction of the elongated rail 1. This may be necessary to transmit the load to the second bridge and at the same time allow for rotation around the third and sixth axis. The rear plate may be provided with a pre-tension that turns the first and second bridge with respect to each other so that the rollers are already pressed against the running surfaces by the pretension.

The first and second bridge 31, 43 may be turnably in an opposite direction. This allows for ease of construction and symmetry such that the load can be suspended from the carriage at two sides.

The first end (e.g. a front end) of one of the first or second bridge is rigidly connected with a front plate 50 which is connected with the first (front end) end of the other one of the first or second bridge 31, 43 by a connection allowing movement of the other one of the first and second bridge with respect to the front plate 50 in a direction parallel to the longitudinal direction of the elongated rail.

The front plate 50 allows the first and second bridge 31, 43 to be turnably with respect to each other while at the same time allowing for stability in the horizontal plane.

The third roller may be closer to the lower end of the elongated rail 1 than the fourth roller. By constructing the second bridge 43 such that the first end of the second bridge 43 is closer to the lower end of the elongated rail 1 the angle of the second bridge with respect to the elongated rail becomes smaller and the forces perpendicular (the load) to the running side 9, 11 become higher.

The second bridge 43 may be constructed in the stairlift making an angle of 10 to 80, more preferably 20 to 65, and most preferably 30 to 50 degrees with respect to the elongated rail 1. The angle of the second bridge 43 with respect to the elongated rail 1 determines the ratio between the forces perpendicular to the side running surface 9, 11 and the stroke that the rollers make with respect to the rail. This ratio becomes better between 10 to 80, more preferably 20 to 65, and most preferably 30 to 50 degrees.

Figure 4:
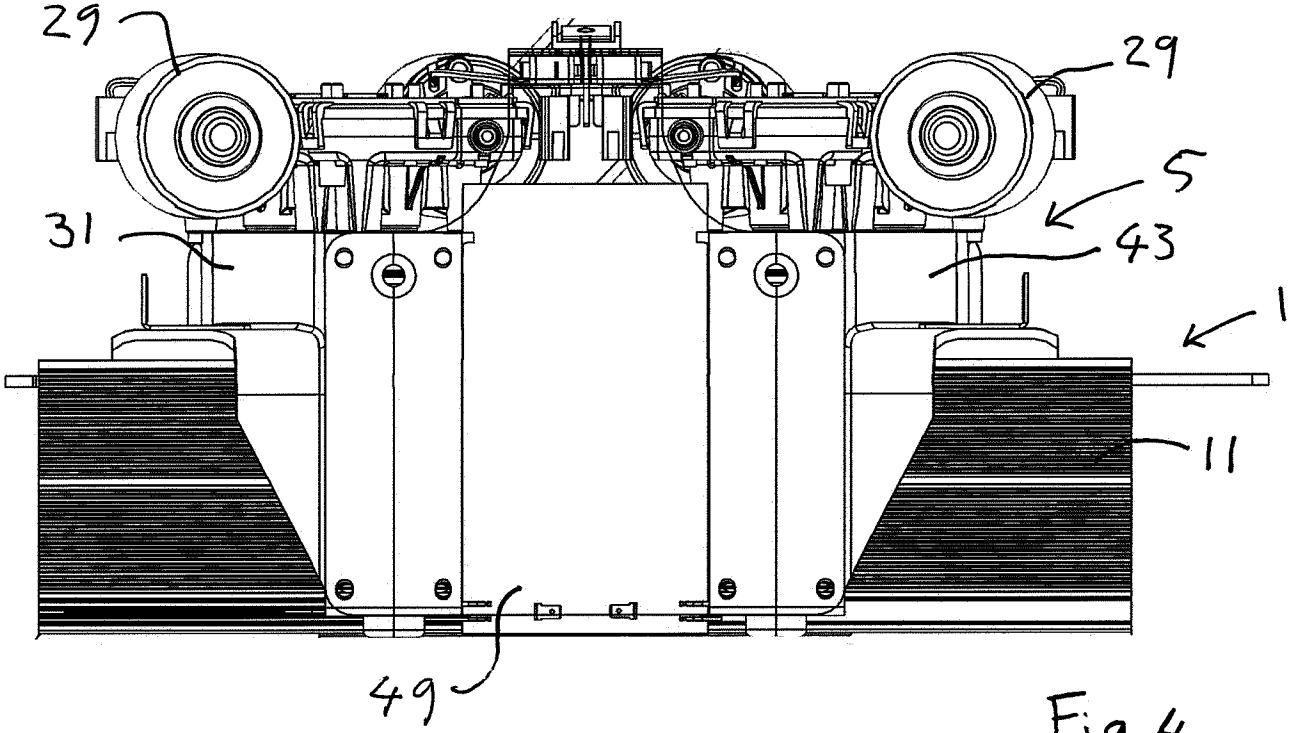
FIG. 4 depicts a side view on the rear plate of the carriage.

FIG. 4 depicts a side view on the rear plate of the carriage. The carriage 5 is moveable over the extended rail 1 with the aid of motors 29. The first and second bridges are connected with a rear plate 49 connecting the first bridge 31 and the second bridge 34 at the second end (e.g. the rear end) of the first and second bridge. The rear plate 49 may transmit the load from the first bridge to the second bridge. The rear plate 49 is bendable in a direction perpendicular to the second side running surface 11 of the elongated rail 1 to allow the first and second bridge to be turnably around the third respectively sixth axis over an angle of 0 to 25, more preferably 0 to 10, and most preferably 0.1 to 2 degrees with respect to a longitudinal direction of the elongated rail 1. This may be necessary to transmit the load from the first to the second bridge and at the same time allow for rotation around the third and sixth axis.

Figure 5:
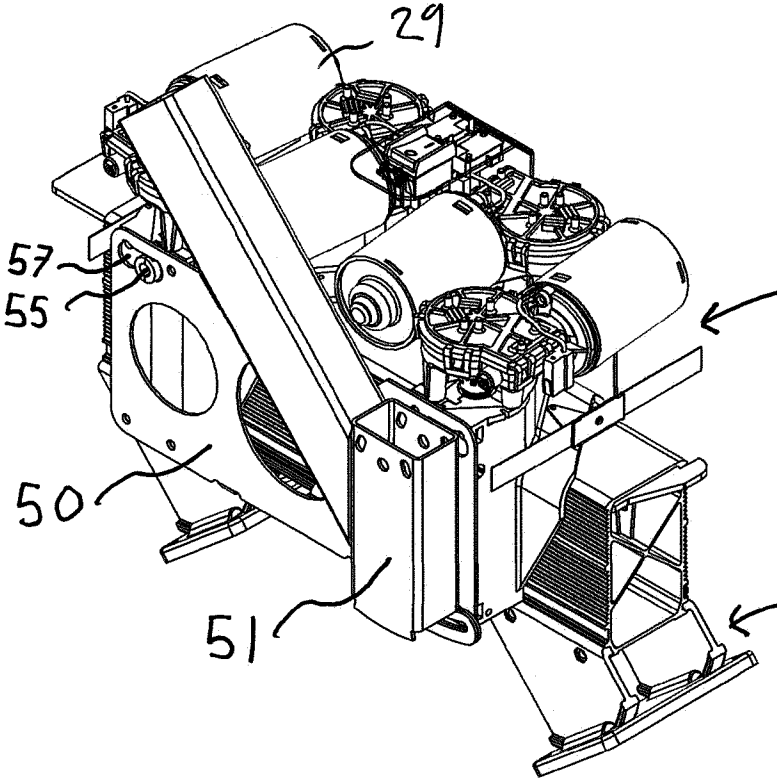
FIG. 5 depicts a side view on the front plate of the carriage.

FIG. 5 depicts a side view on the front plate of the carriage. The carriage 5 is in this embodiment provided with a holder 51 for holding a seat (not shown) and the elongated rail 1 is provided with support struts 53 for supporting the rail on, for example, a staircase. The first end (e.g. front end) of one of the first or second bridge is rigidly connected with the front plate 50 which is connected with the first end (front end) of the other one of the first or second bridge by a connection allowing movement of the other one of the first and second bridge with respect to the front plate 50 in a direction parallel to the longitudinal direction of the elongated rail. The connection may be a runner 55 being provided to the other one of the first and second bridge and being moveable in a slot 57 provided to the front plate 50. The runner 55 in the slot 57 allows the first and second bridge to be turnably with respect to each other while at the same time allowing for stability.

Due to the front plate 50 allowing the first and second bridge to turn with respect to each other the front plate is not transferring any forces from the first to the second bridge in the longitudinal direction of the rail. The forces between the first and second bridge can only be transferred via the rear plate. The load turns the first bridge such that the rollers of the first bridge are pushed into the sides of the rail because the load is suspended from the first bridge at one side of the first bridge. The load also exerts a force on the second bridge via the rear plate which causes the second bridge to turn as well (in opposite direction as the first bridge). The rollers of the second bridge are also pushed into the sides of the rail by the turning of the second bridge thereby improving friction between the rollers and the sides of the rail. The motors 29 provided to the carriage 5 drive each roller such that maximal use is made of the friction of each roller.

It is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Furthermore, the terms and phrases used herein are not intended to be limiting, but rather, to provide an understandable description of the invention.

The terms "a" or "an", as used herein, are defined as one or more than one. The term another or subsequent, as used herein, is defined as at least a second or more. The terms including and/or having, as used herein, are defined as comprising (i.e., not excluding other elements or steps). Any reference signs in the claims should not be construed as limiting the scope of the claims or the invention. The mere fact that certain measures are recited in mutually different dependent claims does not indicate that a combination of these measures cannot be used to advantage. The scope of the invention is only limited by the following claims.

The invention claimed is:

1. A stairlift, for transporting a load along a staircase, comprising:

an elongated rail comprising a first side running surface and a second side running surface opposing the first side running surface; and a carriage movable along the rail said carriage comprising:

a first roller comprising a first roller friction surface which is in frictional engagement with the first side running surface for guiding the first roller; and, a second roller comprising a second roller friction surface which is in frictional engagement with the second side running surface for guiding the second roller; and a first bridge, the first roller being provided rotatable around a first axis at a first end of the first bridge and the second roller being provided rotatable around a second axis at a second end of the first bridge, wherein the first bridge is turnably mounted in the carriage around a third axis substantially parallel to the first and/or second axis and the first bridge is constructed to support the load at a position closer to the first roller than to the second roller the elongated rail is mountable at a lower end and an upper end of the staircase such that the stairlift can move the load up and down the elongated rail from the lower end to the upper end and vice versa, the first roller being constructed closer to the lower end of the elongated rail than the second roller; and a third roller comprising a third roller friction surface which is in frictional engagement with the second side running surface for guiding the third roller; and a fourth roller comprising a fourth roller friction surface which is in frictional engagement with the first side running surface for guiding the fourth roller, wherein the third roller is provided rotatable around a fourth axis in a first end of a second bridge and the fourth roller is provided rotatable around a fifth axis at the second end of the second bridge and the second bridge is turnably around a sixth axis substantially parallel to the fourth and/or fifth axis mounted in the stairlift.

2. The stairlift according to claim 1, wherein the first bridge is turnably rotatable around the third axis over an angle of 0 to 25 degrees with respect to a longitudinal direction of the elongated rail.

3. The stairlift according to claim 1, wherein the first bridge is disposed in the stairlift carriage at an angle of 10 to 80 degrees with a longitudinal direction of the elongated rail.

4. The stairlift according to claim 1, wherein the second bridge is turnably rotatable around the sixth axis over an angle of 0 to 25 degrees with respect to a longitudinal direction of the elongated rail.

5. The stairlift according to claim 4, wherein the third roller friction surface is provided with a third roller member which peripherally extends in a plane perpendicular to a rotational axis of the third roller and fits complementary with the longitudinal second side running surface member for supporting the third roller on the second side running surface; and the fourth roller friction surface is provided with a fourth roller member which peripherally extends in a plane perpendicular to a rotational axis of the fourth roller and fits complementary the longitudinal second side running surface member for supporting the fourth roller on the first side running surface.

6. The stairlift according to claim 1, wherein the first and second bridge are connected with a rear plate connecting the first bridge and the second bridge at a rear end of the first and second bridge.

7. The stairlift according to claim 6, wherein the rear plate is bendable in a direction perpendicular to the second side running surface of the elongated rail to allow the first and second bridge to be turnably rotatable around the third respectively sixth axis over an angle of 0 to 25 degrees with respect to a longitudinal direction of the elongated rail.

8. The stairlift according to claim 1, wherein the first and second bridge are turnably rotatable in an opposite direction.

9. The stairlift according to claim 8, wherein the rear plate is providing with a pretention to turn the first and second bridge in opposite direction.

10. The stairlift according to claim 1, wherein a front end of one of the first or second bridge is rigidly connected with a front plate which is connected with the front end of the other one of the first or second bridge by a connection allowing movement of the other one of the first and second bridge with respect to the front plate in a direction parallel to the longitudinal direction of the elongated rail.

11. The stairlift according to claim 1, wherein the third roller is closer to the lower end of the elongated rail than the fourth roller.

12. The stairlift according to claim 11, wherein the second bridge is disposed in the stairlift at an angle of 10 to 80 degrees with respect to the elongated rail.

13. The stairlift according to claim 1, wherein the first and second bridge are constructed in the stairlift turnably rotatable in the same direction.

14. The stairlift according to claim 1, wherein the first roller friction surface is provided with a first roller member which peripherally extends in a plane perpendicular to a rotational axis of the first roller and the first side running surface is provided with a longitudinal first side running surface member which fits complementary with the first roller member for supporting the first roller on the first side running surface; and the second roller friction surface is provided with a second roller member which peripherally extends in a plane perpendicular to a rotational axis of the second roller and the second side running surface is provided with a longitudinal second side running surface member which fits complementary with the second roller member for supporting the second roller on the second side running surface.

15. The stairlift according to claim 1, wherein each roller is provided with a motor for driving the roller.

16. The stairlift according to claim 15, wherein the motor is supported by the first and/or second bridge.

17. A method of operating a stairlift comprising:

utilizing the stairlift according to claim 1 for transporting a load along the staircase.

* * * * *